US008021126B2

(12) United States Patent
Sishtla et al.

(10) Patent No.: US 8,021,126 B2
(45) Date of Patent: Sep. 20, 2011

(54) COMPRESSOR SOUND SUPPRESSION

(75) Inventors: Vishnu M. Sishtla, Manlius, NY (US); Lee G. Tetu, Baldwinsville, NY (US); William P. Patrick, Glastonbury, CT (US)

(73) Assignee: Carrier Corporation, Farmington, CT (US)

( * ) Notice: Subject to any disclaimer, the term of this patent is extended or adjusted under 35 U.S.C. 154(b) by 1160 days.

(21) Appl. No.: 11/665,954

(22) PCT Filed: Oct. 20, 2004

(86) PCT No.: PCT/US2004/034946

§ 371 (c)(1),
(2), (4) Date: Apr. 19, 2007

(87) PCT Pub. No.: WO2006/043955

PCT Pub. Date: Apr. 27, 2006

(65) Prior Publication Data

US 2009/0060759 A1 Mar. 5, 2009

(51) Int. Cl.
*F04B 39/00* (2006.01)

(52) U.S. Cl. ..... 417/312; 181/229; 181/403

(58) Field of Classification Search ..... 417/312; 181/229, 256, 222, 252, 230
See application file for complete search history.

(56) References Cited

U.S. PATENT DOCUMENTS

| | | | | |
|---|---|---|---|---|
| 2,990,906 | A * | 7/1961 | Audette | 181/256 |
| 4,174,196 | A | 11/1979 | Mori et al. | |
| 4,475,867 | A | 10/1984 | Smith | |
| 5,365,633 | A * | 11/1994 | Sunagawa et al. | 15/326 |
| 5,507,151 | A | 4/1996 | Ring et al. | |
| 5,767,459 | A * | 6/1998 | Sell | 181/258 |
| 6,331,103 | B1 * | 12/2001 | Teraoka | 418/181 |
| 6,488,480 | B1 * | 12/2002 | Zhong | 417/310 |
| 6,672,424 | B2 * | 1/2004 | Gadefait et al. | 181/225 |
| 6,733,258 | B2 * | 5/2004 | Okada et al. | 418/83 |
| 6,875,066 | B2 * | 4/2005 | Wolaver | 440/77 |

FOREIGN PATENT DOCUMENTS

| | | | |
|---|---|---|---|
| EP | 0496591 | A1 | 7/1992 |
| JP | 56054987 | A * | 5/1981 |
| WO | 2006039115 | A1 | 4/2006 |
| WO | 2006039116 | A2 | 4/2006 |

OTHER PUBLICATIONS

International Search Report for PCT/US04/34946, dated Apr. 5, 2005.
Chinese Office Action for CN200480044241.0, dated Dec. 4, 2009.
European Search Report for EP Patent Application No. 04796013.3, dated Sep. 8, 2010.

* cited by examiner

*Primary Examiner* — Charles G Freay
(74) *Attorney, Agent, or Firm* — Bachman & LaPointe, P.C.

(57) ABSTRACT

A compressor has first and second enmeshed rotors: rotating about first and second axes. The first rotor is supported by a bearing system carried by a bearing case. The bearing case has at least a first port to a discharge plenum. A first sound-absorbing material is positioned within the first port.

31 Claims, 4 Drawing Sheets

COMPRESSOR SOUND SUPPRESSION

BACKGROUND OF THE INVENTION

The invention relates to compressors. More particularly, the invention relates to sound and vibration suppression in screw-type compressors.

In positive displacement compressors, discrete volumes of gas are: trapped at a suction pressure; compressed; and discharged at a discharge pressure. The trapping and discharge each may produce pressure pulsations and related noise generation. Accordingly, a well developed field exists in compressor sound suppression.

One class of absorptive mufflers involves passing the refrigerant flow discharged from the compressor working elements through an annular space between inner and outer annular layers of sound-absorptive material (e.g., fiber batting or foam). US Patent Application Pub. No. 2004/0065504 A1 discloses a basic such muffler and then improved versions having integral helmholtz resonators formed within the inner layer. The disclosure of this '504 publication is incorporated by reference herein as if set forth at length.

SUMMARY OF THE INVENTION

Accordingly, one aspect of the invention involves a compressor having first and second enmeshed rotors rotating about first and second axes. The first rotor is supported by a bearing system carried by a bearing case. The bearing case has at least a first port to a discharge plenum. A first sound-absorbing material is positioned within the first port.

Another aspect of the invention involves a compressor having first and second enmeshed rotors rotating about first and second axes. The first rotor is supported by a bearing system carried by a bearing case. The bearing case has at least a first port to a discharge plenum. The compressor includes a muffler system comprising: a sound-absorbing centerbody at least partially within the discharge plenum; and a sound-absorbing outer element at least partially surrounding the centerbody and defining a generally annular flow path portion between the centerbody and outer element. The outer element has an inboard surface at least partially downstream convergent along a first longitudinal span. The centerbody has an outboard surface at least partially downstream divergent along said first longitudinal span.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
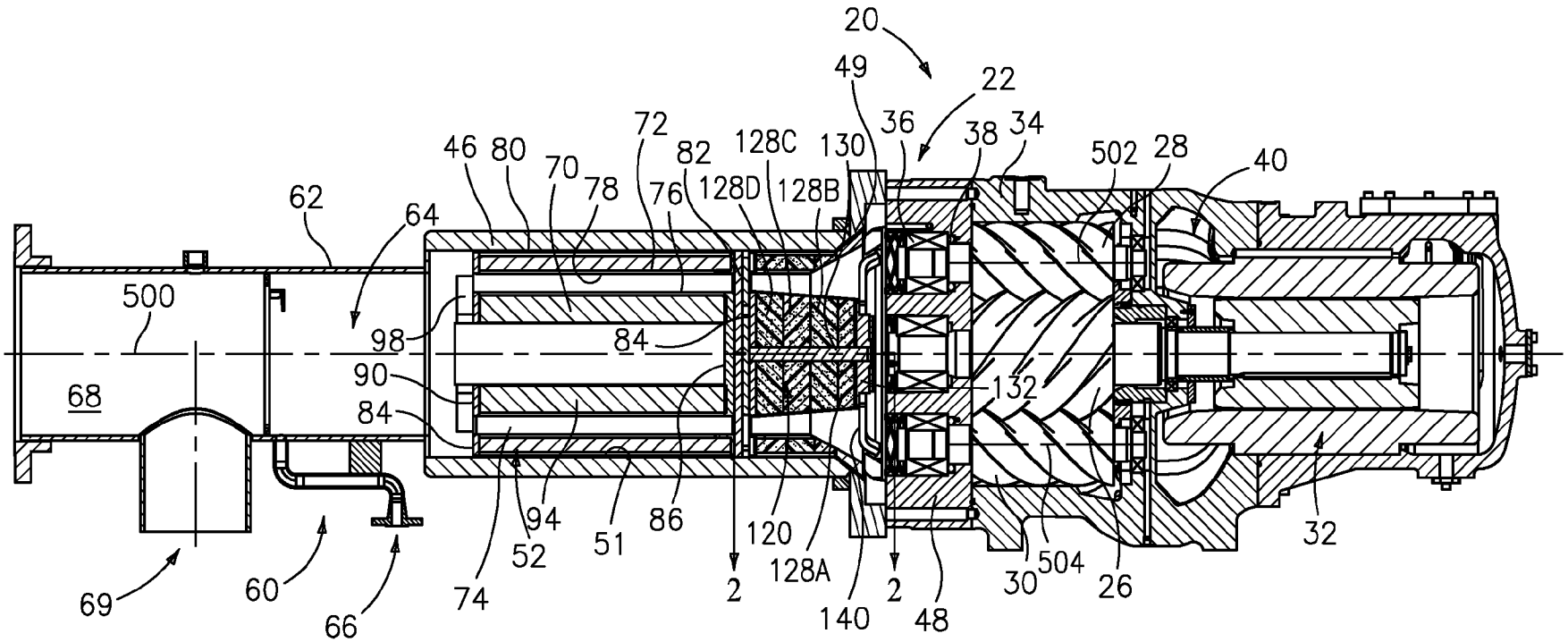
FIG. 1 is a longitudinal sectional view of a compressor.

FIG. 1 shows a compressor 20 having a housing or case assembly 22. The exemplary compressor is a three-rotor, screw-type, hermetic compressor having rotors 26, 28, and 30 with respective central longitudinal axes 500, 502, and 504. In the exemplary embodiment, the first rotor 26 is a male-lobed rotor driven by a coaxial electric motor 32 and, in turn, enmeshed with and driving the female-lobed rotors 28 and 30. In the exemplary embodiment, the male rotor axis 500 also forms a central longitudinal axis of the compressor 20 as a whole. The rotor working portions are located within a rotor case segment 34 of the case assembly 22 and may be supported by bearings 36 and sealed by seals 38 engaging rotor shafts at each end of the associated rotor working portion. When driven by the motor 32, the rotors pump and compress a working fluid (e.g., a refrigerant) along a flowpath from a suction plenum 40 to a discharge plenum 42. The flowpath is divided along distinct compression pockets or compression paths defined by associated pairs of the rotors between the suction and discharge plenums. Thus, the flow splits in the suction plenum and merges in the discharge plenum.

In the exemplary embodiment, the suction plenum 40 is located within an upstream end of the rotor case 34 and the discharge plenum is located generally within an upstream portion discharge/muffler case 46 separated from the rotor case by a bearing case 48 and having a generally downstream-convergent interior surface upstream portion 49. In the exemplary embodiment, a bearing cover/retainer plate (not shown) may be mounted to a downstream end of the bearing case 48 to retain the bearing stacks. The case 46 has a generally cylindrical downstream portion containing a main muffler 52 and having an interior surface portion 51. Downstream of the muffler 52 is an oil separator unit 60 having a case 62 containing a separator mesh 64. An oil return conduit 66 extends from the housing 62 to return oil stopped by the mesh 64 to a lubrication system (not shown). An outlet plenum 68 having an outlet port 69 is downstream of the mesh 64.

The exemplary main muffler 52 includes annular inner and outer elements 70 and 72 separated by a generally annular space 74 (e.g., interrupted by support webs for retaining/positioning the inner element 70). These elements may be formed of sound absorption material (e.g., fiberglass batting encased in a nylon and steel mesh) In the exemplary embodiment, the inner element 70 is retained and separated from the space 74 by an inner foraminate sleeve 76 (e.g., nylon or wire mesh or perforated/expanded metal sheeting) and the outer element 72 is similarly separated and retained by an outer foraminate sleeve 78. In the exemplary embodiment, the outer element 72 is encased within an outer sleeve 80 (e.g., similarly formed to the sleeves 76 and 78) telescopically received within the housing 46. The sleeves 80 and 78 are joined at upstream and downstream ends by annular plates 82 and 84. In the exemplary embodiment, the upstream end of the sleeve 76 is closed by a circular plate 86 and the downstream end closed by an annular plate 90. In the exemplary embodiment, a non-foraminate central core 94 (e.g., steel pipe) extends through the inner element 70 and protrudes beyond a downstream end thereof. At the upstream end of the main muffler, radially-extending connectors 96 join the circular plate 86 to the annular plate 82. At the downstream end, radially-extending connectors 98 connect the annular plates 84 and 90 to hold the inner and outer elements concentrically spaced apart to maintain the annular space 74.

In operation, compressed gas flow exits the compression pockets of the screw rotors 26, 28, 30 and flows into the discharge plenum 42. Upon exiting the compressor discharge plenum, the gas flows down the annular space 74. Upon exiting the muffler, the gas flow, which typically has entrained oil droplets, flows through the oil separating mesh 64. The mesh 64 captures any oil entrained in the gas and returns it to the oil management system by means of the conduit 66. The gas leaves the oil separating mesh and enters the plenum 68 and exits the outlet 69 toward the condenser (not shown).

As so far described, the compressor may be of an existing configuration although the principles of the invention may be applied to different configurations.

Figure 2:
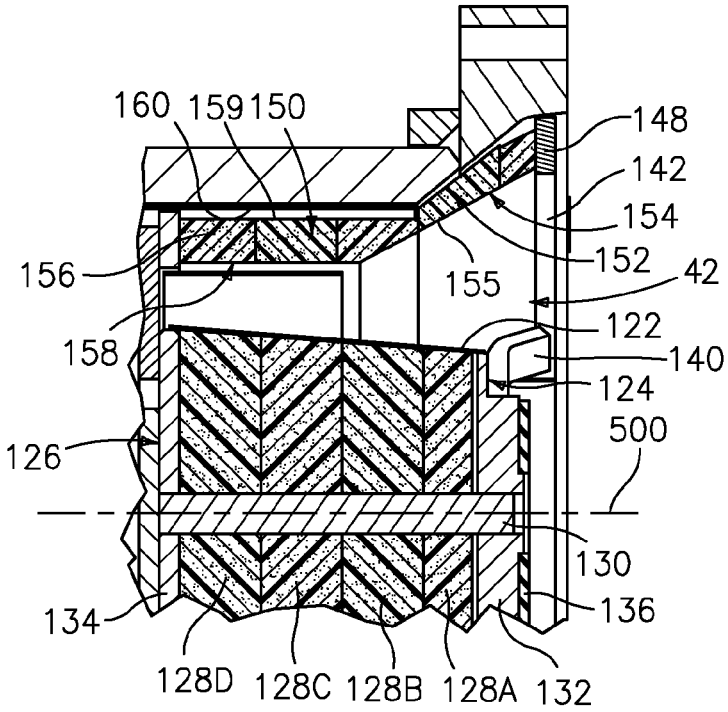
FIG. 2 is an enlarged view of a discharge plenum of the compressor of FIG. 1.

According to one aspect of the present invention, a centerbody 120 is positioned in the flowpath between the rotors and the muffler 52. FIG. 2 shows the centerbody 120 having a generally frustoconical outer surface 122 extending from a circular upstream end/face 124 to a circular downstream end/face 126. In the exemplary embodiment, the centerbody 120 includes a stack of disks 128A-128D of sound-absorbing material. Exemplary material is expanded polypropylene beads (e.g., material known as porous expanded polypropylene (PEPP)). The disks are centrally-apertured and held on a center rod 130 extending between upstream and downstream end plates 132 and 134. A resilient spacer (e.g., neoprene) 136 is positioned ahead of the upstream end plate 132 to engage the bearing cover 50. The upstream end plate 132 includes a number of struts 140 stabilizing the centerbody relative to the discharge/muffler case. The struts 140 extend outward to a metallic ring 142 at a forward/upstream rim portion 148 of a discharge plenum outer muffler section 150. The section 150 includes an upstream portion 152 extending at least partially along the surface portion 49 and having a downstream-converging inboard surface 154 (e.g., formed by a frustoconical portion 155 of a foraminate liner). Downstream thereof, a longitudinally extending portion 156 has a longitudinally-extending inboard surface 158 (e.g., formed by a circular cylindrical tubular portion of such liner) and an outboard surface 159 closely accommodated within a case surface portion 160 extending downstream around the muffler.

The centerbody and outer muffler section 150 may be integrated with the main muffler 52 during assembly as a combined muffler system.

Figure 3:
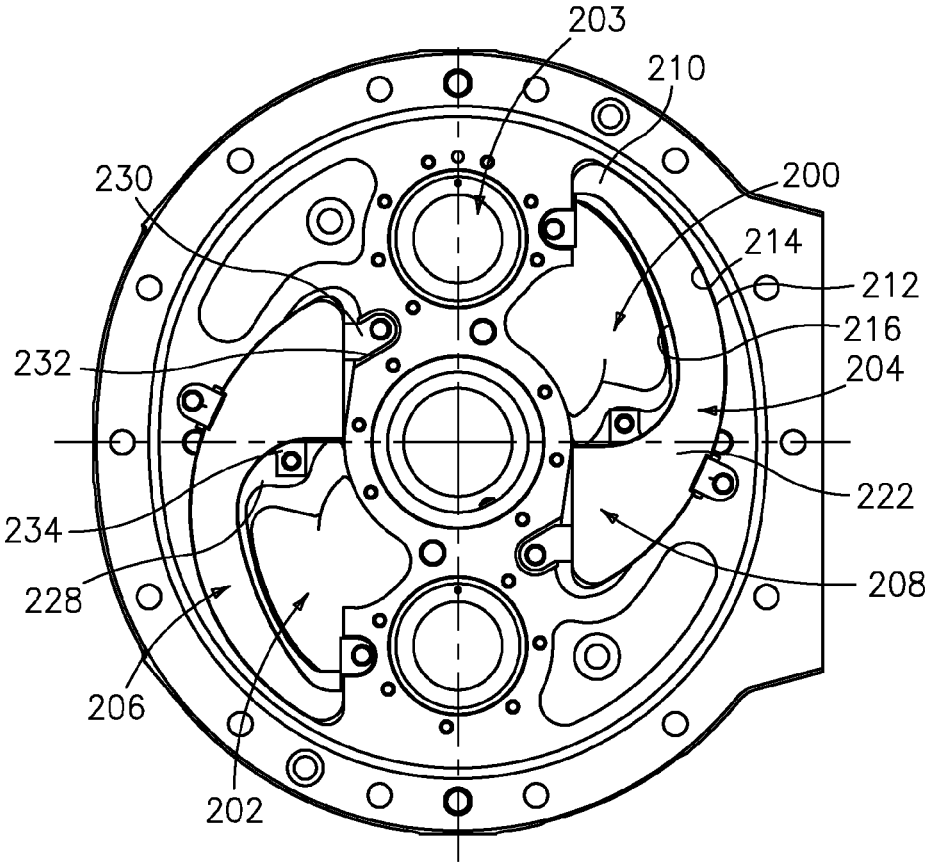
FIG. 3 is a discharge end view of a bearing case of the compressor of FIG. 1.

FIG. 3 shows discharge ports 200 and 202 in the bearing case 48 open to the discharge plenum 42 for discharging the compressed refrigerant. The discharge ports 200 and 202 are oriented to direct the gas flow exiting the rotors to the discharge plenum 42. The ports 200 and 202 are located at the end of the compression pockets produced by the meshing between the male and female rotors. In a two-rotor configuration, only one discharge port would be required. The ports direct the flow around bearing cavities 203 containing the discharge bearings 36 and seals 38. The bearing cavities are enclosed by the bearing cover 50 (FIG. 1).

According to another aspect of the invention, the ports 200 and 202 contain port mufflers 204 and 206. Each exemplary port muffler 204; 206 has a transverse cross-section extending from a first end protuberance 208 generally tapering toward a second end 210. Each port muffler has a generally convex outboard surface 212 abutting a generally concave outboard surface 214 of the associated port. Each port muffler has a generally concave inboard surface 216 facing an open portion of the associated port through which the refrigerant flows from the associated compression pocket.

Figure 4:
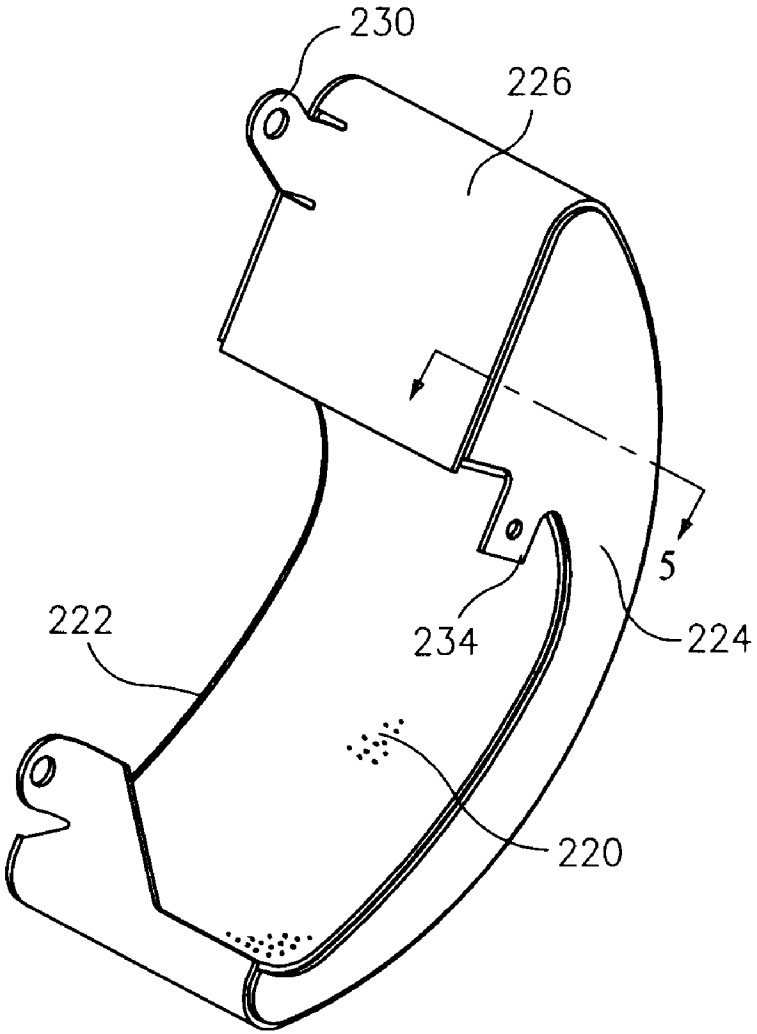
FIG. 4 is a view of a port muffler of the compressor of FIG. 1.

FIG. 4 shows further details of the exemplary port mufflers 204 and 206. The port mufflers comprise a case (e.g., metallic sheet) containing sound-absorbing material (e.g., expanded polypropylene beads known as porous expanded polypropylene (PEPP)). The case advantageously includes a first foraminate (e.g., perforated, perforated/expanded, or mesh; the foraminate nature schematically shown by partial stippling in FIG. 4) portion 220 defining the concave portion 216. A discharge/downstream end portion 222 (also FIG. 3) is also foraminate. The foraminate nature of these portions facilitate passage of refrigerant and sound therethrough. Remaining portions including an upstream end portion 224 and a sidewall portion 226 which extends along the convex portion 212 may be non-foraminate. The upstream end portion 224 may abut or closely face a shoulder 228 (FIG. 3) in the discharge port. The sidewall 226 may include mounting ears 230 for mounting (via associated screws or other fasteners) to a downstream face of the bearing case (potentially accommodated within rebated areas 232 (FIG. 3)). Similarly, the exemplary upstream end portion 224 may have one or more mounting ears 234 for securing to the shoulder surface 228.

Figure 5:
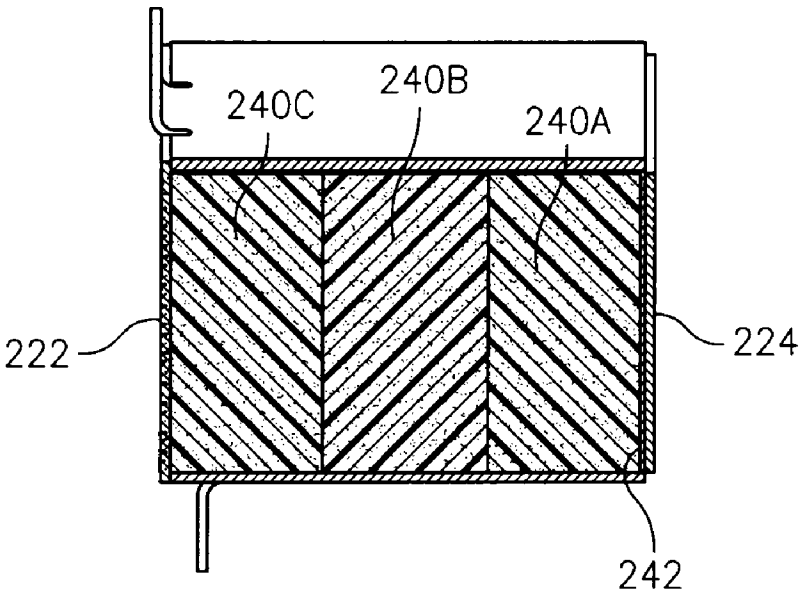
FIG. 5 is a longitudinal sectional view of the port muffler of FIG. 4, taken along line 5-5.

FIG. 5 shows the muffler sound-absorbing material as formed in a stack of three pieces 240A-240C. The exemplary embodiment includes a non-asbestos heat-resistant liner or shield 242 between the upstreammost piece 240A and the port muffler case upstream end portion 224. This shield protects the sound-absorbing material from heat associated with welding the end portion 224 to a remainder of the case during manufacture of the port muffler. For example, the first foraminate portion 220 and downstream end portion 222 may initially be welded to each other and to the sidewall 226. Thereafter, the sound-absorbing material is inserted through the open upstream end along with the shield 242. Thereafter, the upstream end portion 224 may be put in place and welded to the first foraminate portion 220 and sidewall 226.

In the exemplary embodiment, the overall size and shape of the centerbody are chosen to provide a smooth transition from the discharge ports to the muffler. Accordingly, the upstream/front face 124 is sized to correspond to the inboard contours of the ports 200 and 202 defined by the plate 50. This may be at a radius essentially equal to the root radius of the working portion of the rotor 26.

Similarly, the downstream/aft face 126 may be dimensioned correspondingly to the inner element of the muffler (e.g., having a similar outer radius). Similarly, the discharge plenum outer muffler section 150 may be shaped to provide a smooth flow transition to the flow through the annular space 74.

The discharge port mufflers 204 and 206 and their associated compartments in the bearing case may be engineered to provide a desired degree of sound/vibration suppression. The discharge port muffler shape may be influences or dictated by various factors. For example, in a reengineering, it may be desired to essentially preserve the location and shape of the port not occupied by the mufflers (e.g., to maintain the existing flow path for acceptable pressure drop). Structural integrity factors then influence the available bearing case metal for replacement by muffler. In the exemplary implementation, due to insufficient excess bearing case metal between the port and the bearings, the sound absorbing material does not extend along the bearing side of the associated port (FIG. 3). The thickness of the sound absorbing material is another variable. Thickness is governed by the speed of sound in the fluid and the dominant range of frequencies. For the exemplary compressor, the dominant frequency range is about 700-1200 hz. Typically the thickness would be equal to the ¼ wavelength which, in this example amounts to about two inches. Thus, in an iterative engineering of the port mufflers one could measure static pressure drop (e.g., across each port and for which pressure in the discharge plenum may be a proxy) and dynamic pressures at the outlet end of the port. If the static pressure drop is unacceptable, then the flow area (e.g., port cross-sectional area has to be increased). If the dynamic pressure pulsations in the frequency range (e.g., 700-1200 hz) are high then the thickness and length of the muffler may be adjusted. Similar engineering considerations may attend the centerbody and outer muffler section 150. Static pressure drop across the discharge plenum may be measured (e.g., for which pressure at the upstream or downstream end of the main muffler may be a proxy). External sound may be measured (especially along the discharge housing in the same dominant frequency range). Too great a static pressure drop may require expanding the annular cross-sectional flowpath area between the centerbody and outer muffler section at least in one or more locations. Too great an external sound level may require an at least local thickening of the outer muffler section (e.g., optionally with a corresponding local decrease to centerbody cross-sectional area to preserve the local annular cross-sectional flowpath area.

The case inserts and centerbody may be incorporated in the remanufacturing of a compressor or reengineering of a compressor configuration. In the reengineering or remanufacturing, various existing elements may be essentially preserved.

Figure 6:
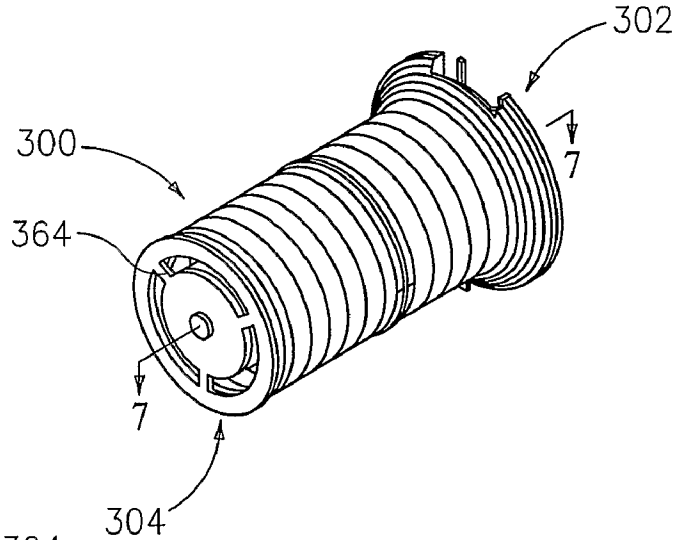
FIG. 6 is a view of a muffler system.
Figure 7:
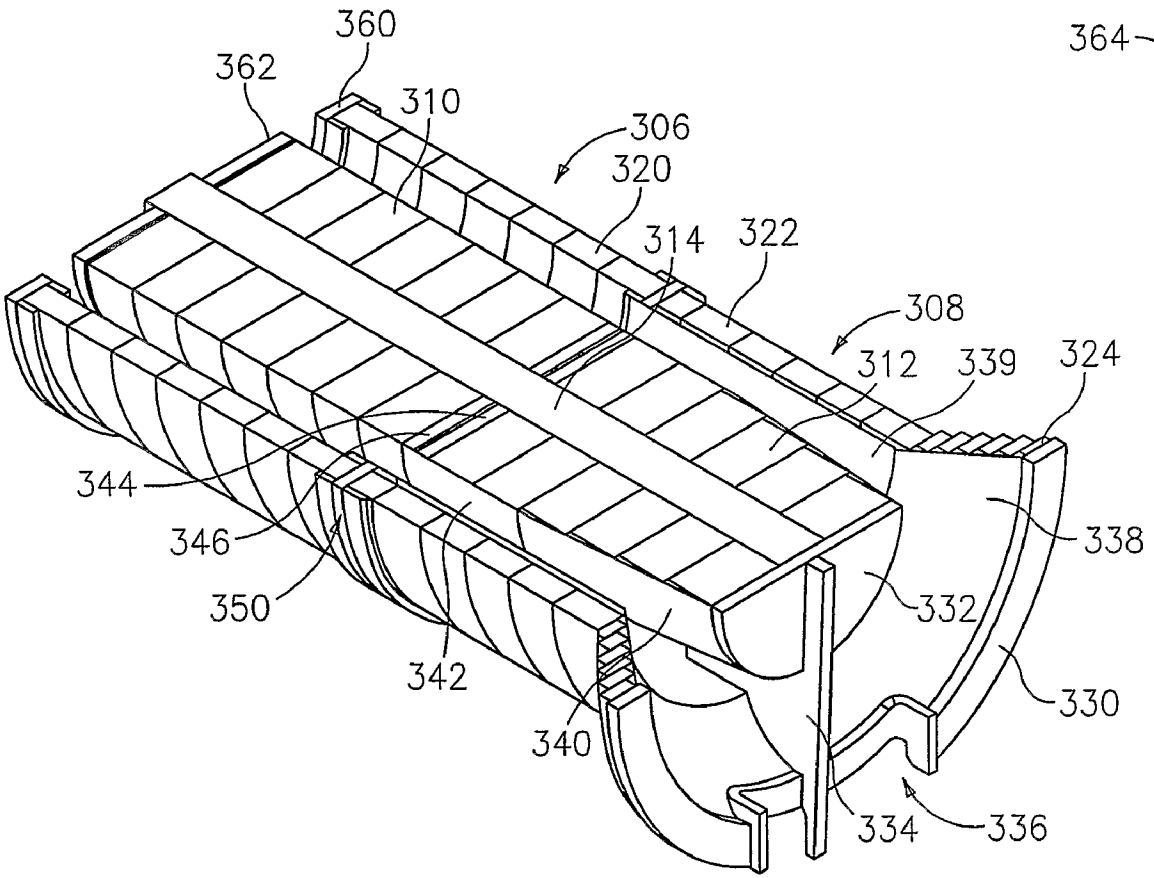
FIG. 7 is a longitudinal sectional view of the muffler system of FIG. 6, taken along line 7-7.

FIG. 6 shows an alternate integrated muffler system 300 extending from an upstream end 302 to a downstream end 304. The system 300 includes a downstream main muffler section 306 assembled to an upstream section 308. The sections 306 and 308 have inner elements formed as respective stacks of disks 310 and 312 on a common center tube 314. In the exemplary embodiment, the disks 310 are of like inner and outer diameter. The disks 312 are of like inner diameter. However, an upstream group thereof has a stepwise increasing outer diameter transitioning to a downstream group of like outer diameter to the disks 310. The longitudinal span of these various disks may be similar and may be determined by the available thicknesses of batts (e.g., of glass fiber) or blocks (e.g., of PEPP) of the sound-absorbing material.

The section 306 has a stack of outer sound-absorbing rings 320 of like inner and outer diameters. The upstream section has two distinct groups of disks 322 and 324. The downstream disks 322 may be of like inner and outer diameter to the disks 320. The upstream disks 324 are of much smaller longitudinal span with a downstream progressive stepwise decreasing inner and outer diameters to form the appropriately converging taper within the discharge plenum. In the exemplary embodiment, an upstream end metallic structural assembly includes an outer ring 330, an inner plate 332, and a longitudinally and diametrically extending web 334 joining the two. The ring 330 may be provided with a pair of diametrically opposed recessed structures 336 for accommodating the bearing case cover plate. The downstream surface of the ring 330 may abut the upstream surface of the leading disk 324 or of a resilient spacer (not shown). A liner may be secured to the ring 330 (e.g., by welding) and may include an upstream frustoconical portion 338 which is downstream convergent and an essentially longitudinally extending circular cylindrical portion 339 extending downstream therefrom. These liner portions 338 and 339 may be foraminate and serve to protect the disks 322 and 324 from damage due to pressure pulsations. Similarly, a foraminate outer jacket for the centerbody may have a downstream-divergent (e.g., frustoconical) upstream portion 340 secured to the inner plate 332 and a circular cylindrical tubular downstream portion 342 extending downstream thereof to a plate 344. By the time the flow reaches the main muffler section 306, the pulsations may be sufficiently damped so that foraminate liners along inboard and outboard peripheries of the annular flowpath may be omitted even if included upstream. An H-sectioned ring 350 captures a downstream portion of the downstreammost disk 322 and an upstream portion of the upstreammost disk 320. An upstream-open U-sectioned channel 360 may be integrally formed with a downstream central end plate 362 such as connected by struts 364 (FIG. 6). The channel 360 captures a downstream portion of the downstreammost disk 320. The plate 362 is essentially apertured to accommodate a downstream portion of the tube 314.

One or more embodiments of the present invention have been described. Nevertheless, it will be understood that various modifications may be made without departing from the spirit and scope of the invention. For example, in a reengineering or remanufacturing situation, details of the existing compressor may particularly influence or dictate details of the implementation. Accordingly, other embodiments are within the scope of the following claims.

What is claimed is:

1. A compressor comprising:
- a first rotor having a first rotational axis;
- a second rotor having a second rotational axis and enmeshed with the first rotor;
- a discharge plenum;
- a first bearing system supporting the first rotor for rotation about the first rotational axis;
- a bearing case carrying the bearing system and having at least a first port to the discharge plenum;
- a first sound absorbing material positioned within the first port;
- a muffler downstream of the discharge plenum; and
- a centerbody within the discharge plenum and spanning a major portion of a length between the bearing case and the muffler.

2. The compressor of claim 1 wherein:
- the centerbody essentially extends from the bearing case to the muffler.

3. The compressor of claim 1 wherein:
- the centerbody is coaxial with the first rotor.

4. The compressor of claim 1 wherein the centerbody comprises:
- an upstream end plate;
- a downstream end plate;
- a connecting member extending between the upstream end plate and the downstream end plate; and
- at least one sound-absorbing element surrounding the connecting member.

5. The compressor of claim 1 wherein:
- the muffler has concentric nested inner and outer elements with an essentially space therebetween.

6. The compressor of claim 1 further comprising:
- a third rotor having a third rotational axis and enmeshed with the first rotor;
- a second bearing system carried by the bearing case and supporting the second rotor for rotation about the second rotational axis; and
- a third bearing system carried by the bearing case and supporting the third rotor for rotation about the third rotational axis;
- a second port in the bearing case; and
- a second sound absorbing material positioned within the second port.

7. The compressor of claim 1 wherein:
- the centerbody has an essentially frustoconical outer surface.

8. The compressor of claim 1 wherein:
- the centerbody has an essentially downstream continuously increasing transverse cross-sectional area.

9. The compressor of claim 1 wherein:
the first sound absorbing material comprises at least one of a fibrous material, a foam material, and an expanded bead material.

10. A muffler element comprising:
a structural body; and
a sound-absorbing material carried by the body,
wherein the body comprises:
first and second ends;
a transversely outwardly convex first sidewall portion;
a transversely outwardly concave second sidewall portion essentially opposite the first sidewall portion and at least partially foraminate;
a first endwall proximate the first end and at least partially foraminate; and
one or more mounting projections having one or more mounting apertures and extending transversely proximate the first end.

11. The element of claim 10 installed in a compressor bearing case.

12. The element of claim 10 wherein the sound absorbing material has an essentially right prismatic shape.

13. The element of claim 10 wherein the sound absorbing material has a transverse cross-sectional shape essentially characterized by:
a first end protuberance; and
an essentially narrowing taper toward a second end.

14. The element of claim 10 wherein the sound absorbing material comprises porous expanded polypropylene.

15. A compressor comprising:
a housing;
a suction plenum;
a plurality of working elements defining a plurality of compression path segments downstream of the suction plenum;
a discharge plenum;
a first muffler downstream of the discharge plenum; and
a plurality of additional mufflers upstream of the discharge plenum and downstream of the plurality of working elements.

16. The compressor of claim 15 wherein:
the plurality of working elements are supported by a plurality of discharge end bearings;
the plurality of discharge end bearings are supported in a discharge end bearing case;
the discharge end bearing case has a plurality of discharge ports; and
each of the plurality of additional mufflers is located essentially within associated one of the discharge ports.

17. The compressor of claim 15 wherein:
each of the plurality of additional mufflers has sound absorbing material consisting essentially of at least one of fibrous material, and foam material, and expanded bead material.

18. The compressor of claim 15 wherein:
each of the plurality of additional mufflers has sound absorbing material consisting essentially of expanded polypropylene beads.

19. A method for remanufacturing a compressor or reengineering a configuration of the compressor comprising:
providing an initial such compressor or configuration having:
a first rotor having a first rotational axis;
a second rotor having a second rotational axis and enmeshed with the first rotor;
a third rotor having a third rotational axis and enmeshed with the first rotor;
a discharge end bearing case having a plurality of discharge ports;
a first bearing carried by the discharge end bearing case and supporting the first rotor;
a second bearing carried by the discharge end bearing case and supporting the second rotor;
a third bearing carried by the discharge end bearing case and supporting the third rotor; and
a discharge plenum;
enlarging at least one of the discharge ports to accommodate a sound-absorbing material; and
placing the sound-absorbing material in the at least one of the discharge ports.

20. The method of claim 19 wherein:
the placing locates first and second mufflers in respective first and second ones of the discharge ports.

21. The method of claim 19 wherein:
the placing leaves the first, second, and third rotors essentially unchanged.

22. The method of claim 19 further comprising:
the placing locates the sound-absorbing material principally along outboard portions of the at least one of the discharge ports.

23. A compressor comprising:
a first rotor having a first rotational axis;
a second rotor having a second rotational axis and enmeshed with the first rotor;
a discharge plenum; and
a muffler system comprising:
a sound-absorbing centerbody at least partially within the discharge plenum; and
a sound-absorbing outer element at least partially surrounding the centerbody and defining a generally annular flow path portion between the centerbody and outer element, wherein:
the outer element has an inboard surface at least partially downstream convergent along a first longitudinal span;
the outer element has an outboard surface at least partially downstream convergent along the first longitudinal span; and
the centerbody has an outboard surface at least partially downstream divergent along said first longitudinal span.

24. The compressor of claim 23 wherein:
along a majority of a total longitudinal span of the outer element, the inboard surface is essentially non-convergent and non-divergent; and
along a majority of a total longitudinal span of the centerbody, the outboard surface is essentially non-convergent and non-divergent.

25. The compressor of claim 23 wherein:
said first longitudinal span is at least 15% of a total longitudinal span of the muffler system.

26. The compressor of claim 23 wherein:
the muffler system comprises a central inner tube extending along at least 80% of a total longitudinal span of the muffler system.

27. The compressor of claim 23 wherein:
along the first longitudinal span the outer element comprises a plurality of radially staggered rings of like radial span.

28. A compressor comprising:
a first rotor having a first rotational axis;
a second rotor having a second rotational axis and enmeshed with the first rotor;
a discharge plenum; and
a muffler system comprising:

a sound-absorbing centerbody at least partially within the discharge plenum; and a sound-absorbing outer element at least partially surrounding the centerbody and defining a generally annular flow path portion between the centerbody and outer element, wherein:

the outer element has an inboard surface at least partially downstream convergent along a first longitudinal span;

the muffler system comprises a central inner tube extending along at least 80% of a total longitudinal span of the muffler system; and the centerbody has an outboard surface at least partially downstream divergent along said first longitudinal span.

29. The compressor of claim 28 wherein:

said first longitudinal span is at least 15% of a total longitudinal span of the muffler system.

30. A compressor comprising:

a first rotor having a first rotational axis;

a second rotor having a second rotational axis and enmeshed with the first rotor;

a discharge plenum; and a muffler system comprising:

a sound-absorbing centerbody at least partially within the discharge plenum; and a sound-absorbing outer element at least partially surrounding the centerbody and defining a generally annular flow path portion between the centerbody and outer element, wherein:

the outer element has an inboard surface at least partially downstream convergent along a first longitudinal span;

along the first longitudinal span the outer element comprises a plurality of radially staggered rings of like radial span; and the centerbody has an outboard surface at least partially downstream divergent along said first longitudinal span.

31. The compressor of claim 30 wherein:

said first longitudinal span is at least 15% of a total longitudinal span of the muffler system.

* * * * *